US005352278A

United States Patent [19]

Korver et al.

[11] Patent Number: 5,352,278

[45] Date of Patent: Oct. 4, 1994

[54] MARKING POWDER FOR AND METHOD OF MARKING A METALLIC ARTICLE

[75] Inventors: Johannes C. Korver, Noord-Scharwoude; Bala K. Paramanathan, Heemstede; Andries C. de Muijnck, Heiloo, all of Netherlands

[73] Assignee: Hoogovens Groep B.V., Ijmuiden, Netherlands

[21] Appl. No.: 128,572

[22] Filed: Sep. 30, 1993

[30] Foreign Application Priority Data

Sep. 30, 1992 [NL] Netherlands ..... 9201690

[51] Int. Cl.[5] ..... C09D 11/00

[52] U.S. Cl. ..... 106/19 D; 106/19 R; 106/403; 106/404

[58] Field of Search ..... 106/19 D, 19 R, 403, 106/404

[56] References Cited

U.S. PATENT DOCUMENTS 2,031,070 2/1936 Robinson et al. ..... 428/187

4,891,068 1/1990 Masumoto et al. ..... 75/251

5,090,983 2/1992 Boaz ..... 65/25.4

FOREIGN PATENT DOCUMENTS 2308999 11/1976 France .

609644 10/1948 United Kingdom .

1495097 12/1977 United Kingdom .

*Primary Examiner*—Karl Group

*Assistant Examiner*—Chris Gallo

*Attorney, Agent, or Firm*—Stevens, Davis, Miller & Mosher

[57] ABSTRACT

A marking powder is disclosed for marking metallic bodies, in particular hot metallic bodies, which may be steel or other ferrous metal. Zinc is present in the marking powder in an amount 20 to 70% by weight, and it found that this results in improved legibility, which lasts for longer.

The powder may be prepared by adding zinc powder to a known aluminum-based marking powder in an appropriate ratio.

Coarse zinc powder was found to be better.

11 Claims, No Drawings

MARKING POWDER FOR AND METHOD OF MARKING A METALLIC ARTICLE

FIELD OF THE PRESENT INVENTION

The invention relates to a marking powder suitable for marking a metallic body, particularly a hot metallic body, comprising metallic powder, binding agent and pigment. The invention also relates to a method for marking a metallic body with the aid of the marking powder.

BACKGROUND OF THE PRESENT INVENTION

GB 1495097 discloses a marking powder containing a pigment, an adhesion agent, and aluminium powder. The legibility of markings applied using such a known marking powder is found in practice to diminish after only a few weeks. Moreover, on some bodies such as steel slabs and billets stored outdoors, contamination depositing on the markings is disadvantageous. For example, particles of rust are found to deposit on the markings thereby further diminishing legibility.

SUMMARY OF THE PRESENT INVENTION

The object of the present invention is to obviate these drawbacks and to provide a marking powder with which markings may be applied to a metal body, particularly a hot metal body, which remain easily legible for a long time even under less favourable conditions.

The marking powder in accordance with the invention is characterized in that it comprises 20–70 percent by weight zinc powder. It has been found that applying a marking in the form of a marking powder to which zinc powder is added is more legible and remains legible for longer.

Various aspects are of importance for the legibility of the marking powder applied and its workability.

The marking powder preferably comprises 30 to 60% by weight zinc powder, more preferably 40 to 50% by weight.

An effective marking powder is obtained if the marking powder comprises 8 parts by weight aluminium powder, 5 parts by weight bentonite as binding agent, 2 parts by weight $TiO_2$ as pigment and 4–18, preferably 8–15 parts by weight zinc powder. Preferably, there are no other constituents other than unavoidable impurities.

The zinc powder preferably possesses a particle size of 5–25 μm for over 60 percent by weight.

More preferably the zinc powder has a particle size distinction given by, in % by weight;

—≦5%<5 μm

—15–25% 5–10 μm

—55–65% 10–25 μm

—10–20% 25–50 μm

The particle size of the binding agent is preferably <200 μm, and more preferably is <75 μm for 75 percent by weight.

For very good legibility it is preferable for the particle size of the pigment to be ≦5 μm.

The particle size of the aluminium powder (when present) is preferably <400 μm.

The present invention also relates to a method of marking a metallic body by spraying thereon such a marking powder. To achieve the best results, the marking powder should be applied to an object having a temperature above 420° C. It is believed that this is due to partial melting of the zinc powder providing a smooth, well binding marking.

The present invention also relates to the use of zinc powder in the preparation of a powder for marking an article, wherein the marking powder produced contains zinc in an amount of 20 to 70% by weight.

The powder of the present invention is particularly suited for marking steel or other ferrous billets, but is applicable to other metallic articles.

DETAILED DESCRIPTION OF THE PREFERRED EMBODIMENT

The present invention will now be illustrated by reference to the results of test markings applied to steel billets using a series of marking powders, with compositions ranging from powders in which aluminium is the sole metal constituent to powders in which the predominant constituent is zinc, and also pure zinc powder.

The billets were marked by spraying with a beaker spray gun. During spraying the powder is supplied cold and the billet is hot, above 420° C. The markings were examined for legibility immediately, when the billets had cooled down, and, when possible, after periods of 4, 8 and 12 months. Often, however, an experiment was prematurely terminated because the billet was required for other purposes. The workability of the powder was recorded. The results of this examination are given in Table 1.

In Table 1, marking powder 1 is a known marking powder which produces markings with an initially "acceptable" legibility. However, after a few months the legibility falls to an unacceptable level.

Marking powder 2 contains 15 parts by weight of a known composition to which 12 parts by weight zinc powder was added. As can be seen, the initial legibility was improved over marking powder 1.

Marking powder 3 has the same composition as No. 1, except that zinc powder is used instead of aluminium. Again, the initial legibility was improved, and the legibility was acceptable for many months.

Marking powders 4 to 20 have a base composition in parts by weight 8:5:2 (metallic powder:bentonite:$TiO_2$) with aluminium as the metallic powder, to which between 6 and 108 parts by weight zinc powder have been added. The results show first of all that zinc powder as metallic powder in the base composition or addition of zinc powder to the base composition comprising aluminium powder up to approximately 24 parts by weight improves legibility and duration of good legibility of marks on articles marked whilst hot and subsequently cool. Particularly striking is the long period of adequate legibility using marking powder 7. Furthermore the tests repeatedly show that the workability of the marking powder is improved through the use of coarser zinc powder.

In order to verify this, marking powders 21 to 23 composed of pure zinc were tested for workability, to confirm the relationship between workability and coarseness of the zinc powder added.

Table 2 gives the particle size distribution corresponding to the terms "coarse" "medium" and "fine" in Table 1.

TABLE 1

| Number | Base composition 8 parts by weight metallic powder 5 parts by weight bentonite 2 parts weight $TiO_2$ Total 15 parts by weight: Metallic Powder Al | Metallic Powder Zn | Parts by Weight added to base components Zn | Overall % by Weight Zn | Zinc powder 1 = coarse 2 = medium 3 = fine (See Table 2) | Work-ability | Legibility after Application: Before Cooling | After Cooling | Legibility after x months: x = 4 | x = 8 | x = 12 |
|---|---|---|---|---|---|---|---|---|---|---|---|
| 1 | X | | 0 | 0 | N.A. | + | □ | □ | - - | N.A. | N.A. |
| 2 | X | | 12 | 44 | 3 | − | + | N.E. | N.E. | N.E. | N.E. |
| 3 | | X | 0 | 53 | 3 | − | + | + | □ | □ | □ |
| 4 | X | | 6 | 29 | 1 | + | + | + | + | N.E.T. | N.E.T. |
| 5 | X | | 12 | 44 | 3 | − | + | + | + | N.E.T. | N.E.T. |
| 6 | X | | 12 | 44 | 2 | □ | □ | + | + | N.E.T. | N.E.T. |
| 7 | X | | 12 | 44 | 1 | + | + | + | + | + | + |
| 8 | X | | 18 | 55 | 1 | + | + | + | + | N.E.T. | N.E.T. |
| 9 | X | | 24 | 62 | 3 | − | □ | + | + | N.E.T. | N.E.T. |
| 10 | X | | 24 | 62 | 2 | □ | + | + | + | N.E.T. | N.E.T. |
| 11 | X | | 24 | 62 | 1 | + | + | + | + | N.E.T. | N.E.T. |
| 12 | X | | 36 | 71 | 3 | − | − | N.E. | N.E. | N.E. | N.E. |
| 13 | X | | 36 | 71 | 2 | □ | − | N.E. | N.E. | N.E. | N.E. |
| 14 | X | | 36 | 71 | 1 | + | □ | N.E. | N.E. | N.E. | N.E. |
| 15 | X | | 54 | 78 | 3 | − | − | N.E. | N.E. | N.E. | N.E. |
| 16 | X | | 54 | 78 | 2 | □ | − | N.E. | N.E. | N.E. | N.E. |
| 17 | X | | 54 | 78 | 1 | + | □ | N.E. | N.E. | N.E. | N.E. |
| 18 | X | | 108 | 88 | 3 | − | − | N.E. | N.E. | N.E. | N.E. |
| 19 | X | | 108 | 88 | 2 | □ | − | N.E. | N.E. | N.E. | N.E. |
| 20 | X | | 108 | 88 | 1 | + | − | N.E. | N.E. | N.E. | N.E. |
| 21 | | | (100% Zn Powder) | | 3 | − | − | N.E. | N.E. | N.E. | N.E. |
| 22 | | | (100% Zn Powder) | | 2 | □ | − | N.E. | N.E. | N.E. | N.E. |
| 23 | | | (100% Zn Powder) | | 1 | + | − | N.E. | N.E. | N.E. | N.E. |

N.A. = Not applicable
N.E. = Not Examined
N.E.T. = Not Known; experiments prematurely terminated
+ = Good
□ = Acceptable
− = Poor
- - = Very poor

TABLE 2

| Grain Size | Zinc Powder: Coarse | Medium | Fine |
|---|---|---|---|
| <5μ (%) | ≦5 | 25–30 | 60–70 |
| 5–10μ (%) | 15–25 | 25–35 | 10–30 |
| 10–25μ (%) | 55–65 | 10–35 | 0 |
| 25–50μ (%) | 10–20 | ≦5 | 0 |

We claim:

1. A marking powder for marking a metallic article, comprising a binding agent, a pigment and zinc powder in an amount in the range of 20 to 70% by weight of the marking powder.

2. A marking powder according to claim 1 containing 30 to 60% by weight zinc powder.

3. A marking powder according to claim 1 containing 40 to 50% by weight zinc powder.

4. A marking powder according to claim 1, wherein the particle size of at least 50% by weight of the zinc powder is between 5 and 25 μm.

5. A marking powder according to claim 1, wherein the zinc powder has the particle size distribution in % by weight —≦5% <5 μm
—15–25% 5–10 μm
—55–65% 10–25 μm
—10–20% 25–50 μm.

6. A marking powder according to claim 1, wherein the average particle size of the binding agent is 200 μm.

7. A marking powder according to claim 1, wherein at least 75% by weight of the binding agent has a particle size of less than 75 μm.

8. A marking powder according to claim 1, wherein the average particle size of the pigment is less than 5 μm.

9. A marking powder for marking a hot metallic article, containing:

8 parts by weight aluminium powder;
5 parts by weight bentonite;
2 parts by weight $TiO_2$; and
6 to 24 parts by weight zinc powder.

10. A marking powder according to claim 9, wherein the zinc powder is present in an amount between 8 and 15 parts by weight.

11. A marking powder according to claim 9, wherein the average particle size of the aluminium powder is less than 400 μm.

* * * * *